US006558197B1

(12) United States Patent
Chen et al.

(10) Patent No.: US 6,558,197 B1
(45) Date of Patent: May 6, 2003

(54) LOW PROFILE MODULAR JACK

(75) Inventors: Qiang Chen, Kunsan (CN); GuaNG Xing Shi, Kunsan (CN); Suiya Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,086

(22) Filed: Dec. 28, 2001

(51) Int. Cl.[7] ..... H01R 13/648
(52) U.S. Cl. ..... 439/607; 439/344
(58) Field of Search ..... 439/607–610, 439/676, 344

(56) References Cited

U.S. PATENT DOCUMENTS 6,190,210 B1 * 2/2002 Belopolsky et al. ..... 439/676
6,354,883 B2 * 3/2002 Jaing ..... 439/676

* cited by examiner

*Primary Examiner*—P. Austin Bradley
*Assistant Examiner*—Ross Gushi
(74) *Attorney, Agent, or Firm*—Wei Te Chung

(57) ABSTRACT

A modular jack connector comprises a housing (10), a plurality of terminals (20) received in the housing and a shield (30) enclosing the housing. The housing has a pair of sidewalls (101, 102), a bottom wall (103), a top wall (104) and a rear wall (105) together defining a receiving space (15) therebetween. The top wall defines an opening (12) in a front face thereof. The shield comprises a pair of side plates (301, 302), a top plate (304) and a rear plate (305) corresponding to the walls of the housing. The top plate defines a window (31) in a front edge thereof in communication with the opening and has a pair of opposite stoppers (32) extending into the window for engaging a latch (41) of a plug connector (40).

10 Claims, 6 Drawing Sheets

LOW PROFILE MODULAR JACK

BACKGROUND OF THE INVENTION

1. Field of the Invention

The present invention generally relates to a modular jack connector, and particularly to a modular jack connector having a low profile.

2. Description of Related Art

With the development of the electrical technology, notebooks are widely used and getting smaller and smaller. Thus, the modular jack connector used in the notebook for electrically connecting a mating plug connector to a printed circuit board (PCB) should be minimized in size to meet this demand. Referring to FIG. 6, a conventional modular jack connector comprises a housing 5 and a shield 6 enclosing the housing 5. The housing 5 comprises a pair of lateral sidewalls 52, 53, a top wall 54, a bottom wall 55 and a rear wall 56 together defining a receiving space 51 therebetween. The top wall 54 comprises a window 541 for receiving an enlarged front portion of a latch of a plug connector (not shown) and a pair of upper blocks 542 in front of the window 541 for abutting against a rear edge of the enlarged front portion of the latch for preventing the mating plug connector from separating from the modular jack connector.

The conventional modular jack connector is relatively thick due to the provision of the pair of upper blocks 542. Therefore, provides an improved modular jack connector having a relatively low profile is desired to overcome the disadvantage of the conventional modular jack and to meet the requirement of the miniaturization of the notebook.

SUMMARY OF THE INVENTION

Accordingly, the object of the present invention is to provide a low profile modular jack connector having a shield with a pair of plug latch stoppers.

In order to achieve the object set forth, a modular jack connector in accordance with the present invention comprises a housing, a plurality of terminals received in the housing and a shield enclosing the housing. The housing has a pair of sidewalls, a bottom wall, a top wall and a rear wall together defining a receiving space therebetween. The top wall defines an opening in a longitudinal direction. The shield comprises a pair of side plates, a top plate and a rear plate corresponding to the walls of the housing. The top plate defines a window corresponding to the opening and has a pair of opposite stoppers extending into the window for preventing an inserted plug connector received in the received space separating from the modular jack connector.

Other objects, advantages and novel features of the invention will become more apparent from the following detailed description when taken in conjunction with the accompanying drawings.

DETAILED DESCRIPTION OF THE INVENTION

Figure 1:
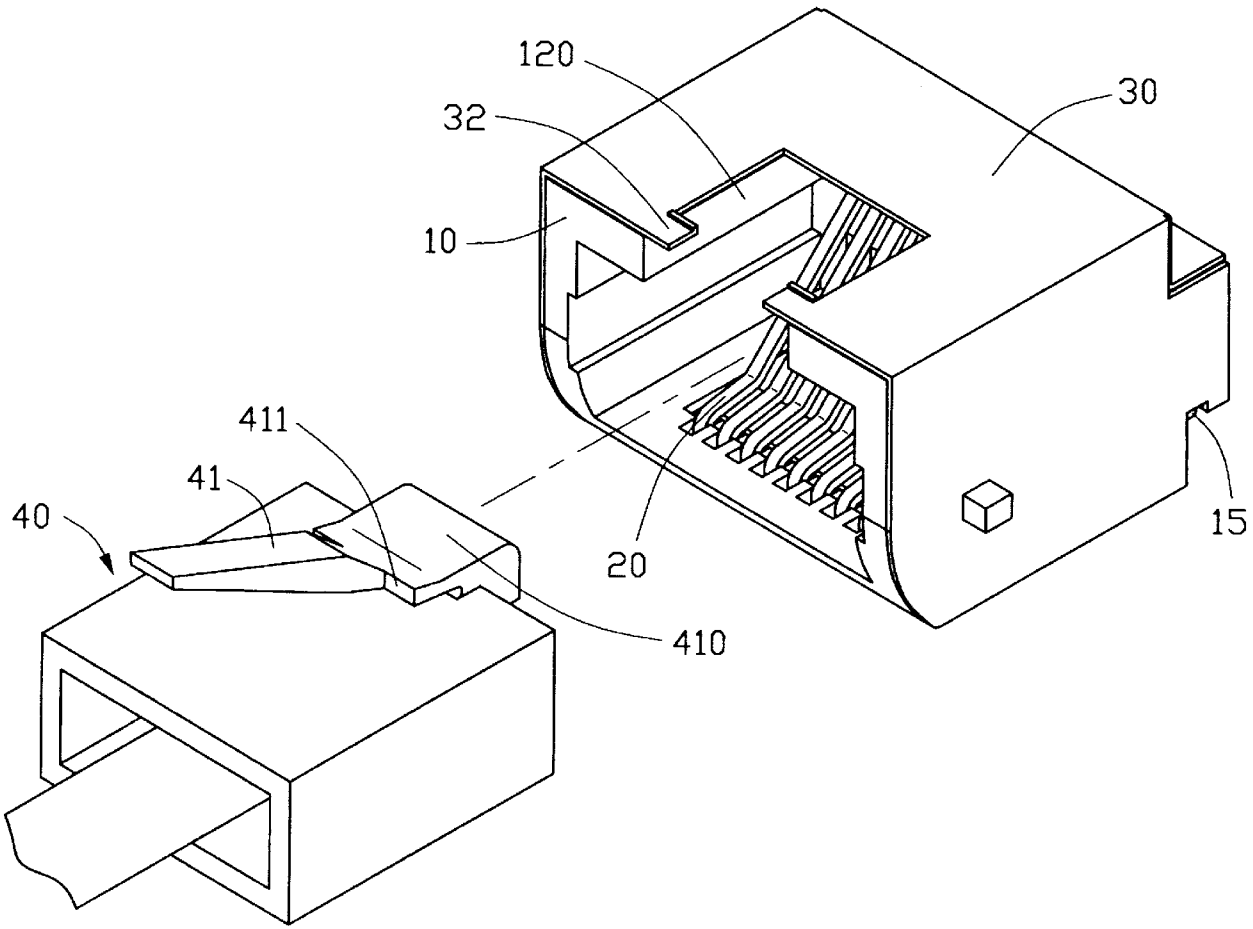
FIG. 1 is a perspective view of a low profile modular jack constructed in accordance with the present invention and a mating plug connector.

Referring to FIG. 1, a low profile modular jack in accordance with the present invention comprises an insulative housing 10, a plurality of terminals 20 received in the housing 10 and a shield 30 enclosing the housing 10.

Figure 2:
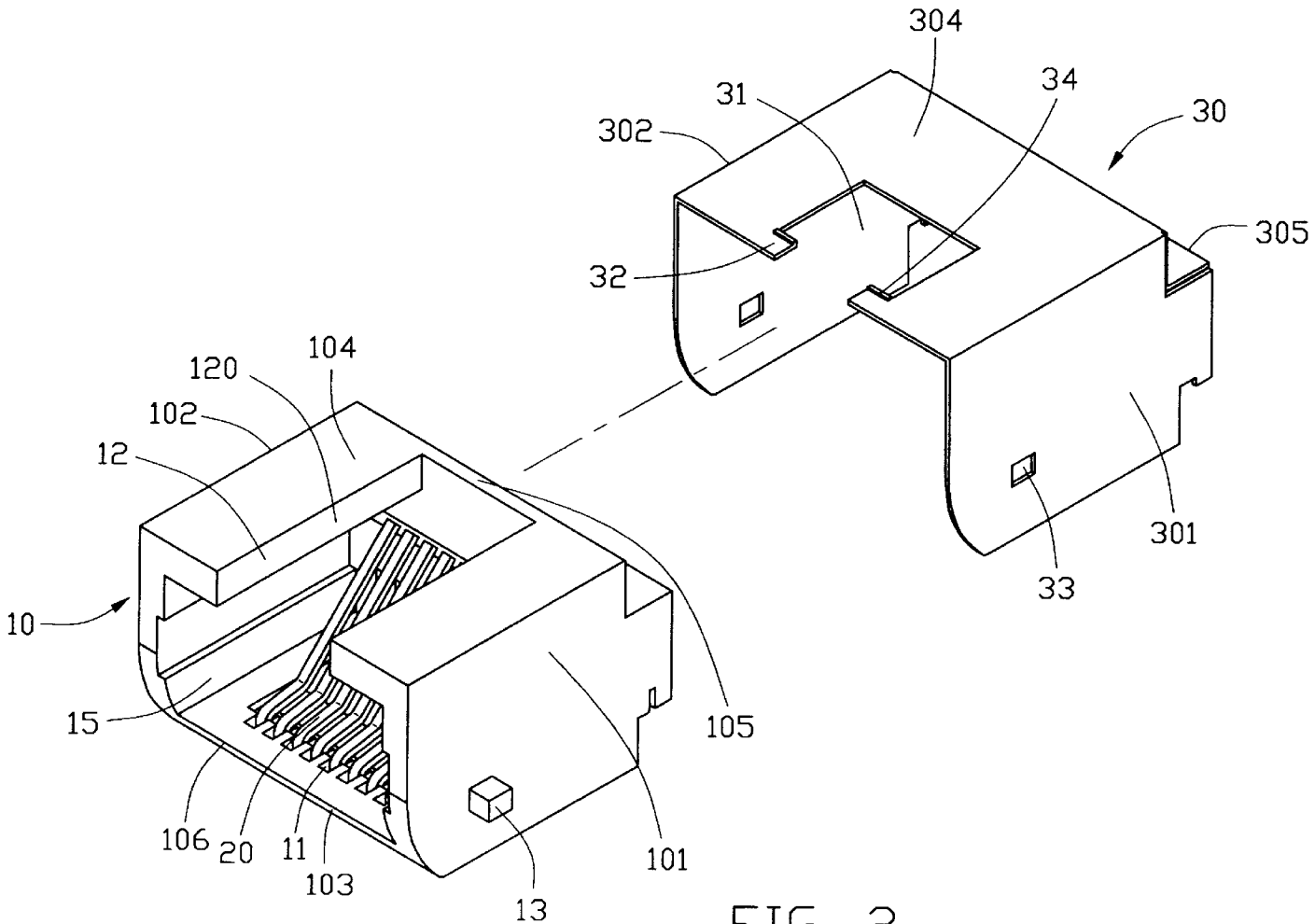
FIG. 2 is an exploded perspective view of the modular jack shown in FIG. 1.
Figure 4:
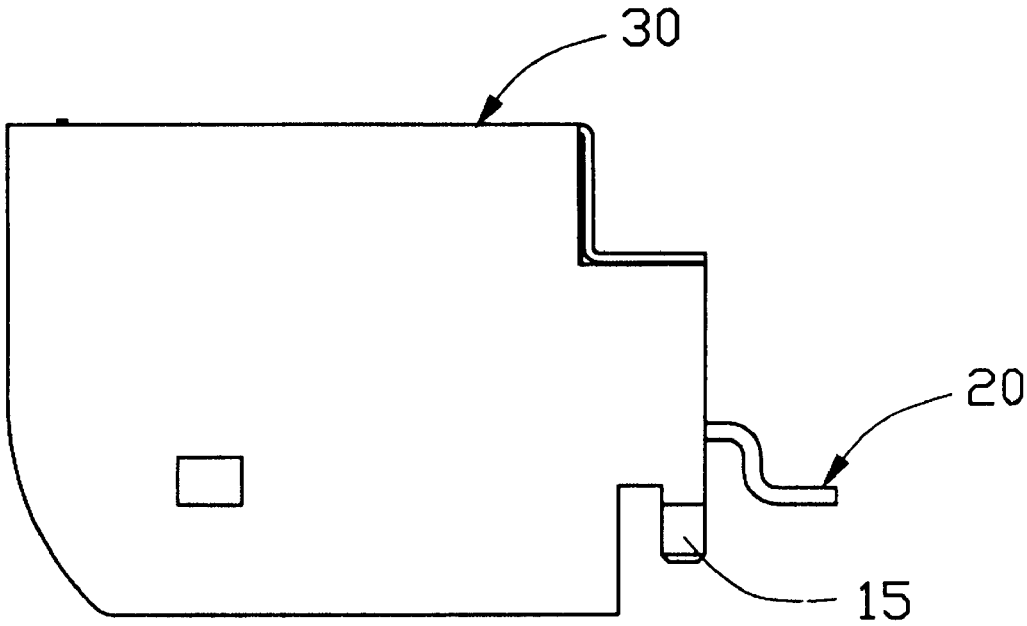
FIG. 4 is a side view of the modular jack shown in FIG. 1.

Referring to FIGS. 1, 2 and 4, the housing 10 is substantially rectangular and made of plastic material. The housing 10 has a pair of sidewalls 101, 102, a bottom wall 103, a top wall 104, and a rear wall 105 together defining a receiving space 15 therebetween for receiving a mating plug connector 40. A front opening 106 is defined in communication with the receiving space 15. The mating plug connector 40 can be inserted into the receiving space 15 from the front opening 106. The top wall 104 defines an opening 12 in a longitudinal direction from the front opening 106 to the rear wall 105. The opening 12 defines a pair of opposite sidewalls 120. Each sidewall 101, 102 has a block 13 formed on an outside thereof. The plurality of terminals 20 are received in a plurality of passageways 11 defined in the bottom and rear walls 103, 105 and extend out of the rear wall 105. A pair of posts 15 downwardly extend from a bottom end of the rear wall 105 for mounting the housing 10 on a printed circuit board (not shown).

The shield 30 is unitarily stamped and comprises a pair of side plates 301, 302, a top plate 304 and a rear plate 305 corresponding to the walls of the housing 10. The top plate 304 defines a window 31 corresponding to the opening 12 for receiving a latch 41 of the mating plug connector 40. A pair of stoppers 32 extend toward each other into the window 31 and beyond corresponding sidewalls 120 of the opening 12. Each stopper 32 has a protrusion 34 upwardly extending from a rear edge thereof. After the mating plug 40 is inserted in the receiving space 15, the latch 41 is received in the window 31 and a rear edge 411 of an enlarged front portion 410 thereof abuts against the protrusions 34, whereby the mating plug connector 40 is prevented from separating from the window 31. The pair of side plates 301, 302 respectively define a pair of holes 33 for receiving the pair of blocks 13.

Figure 3:
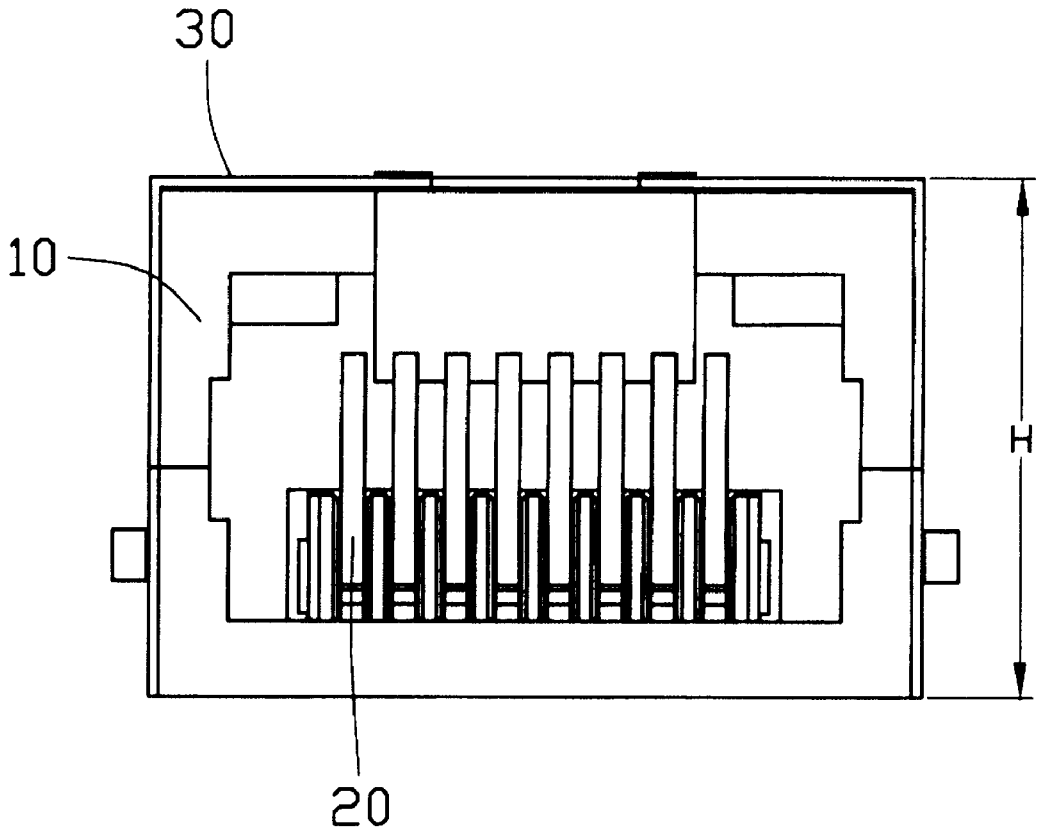
FIG. 3 is a front plan view of the modular jack shown in FIG. 1.
Figure 5:
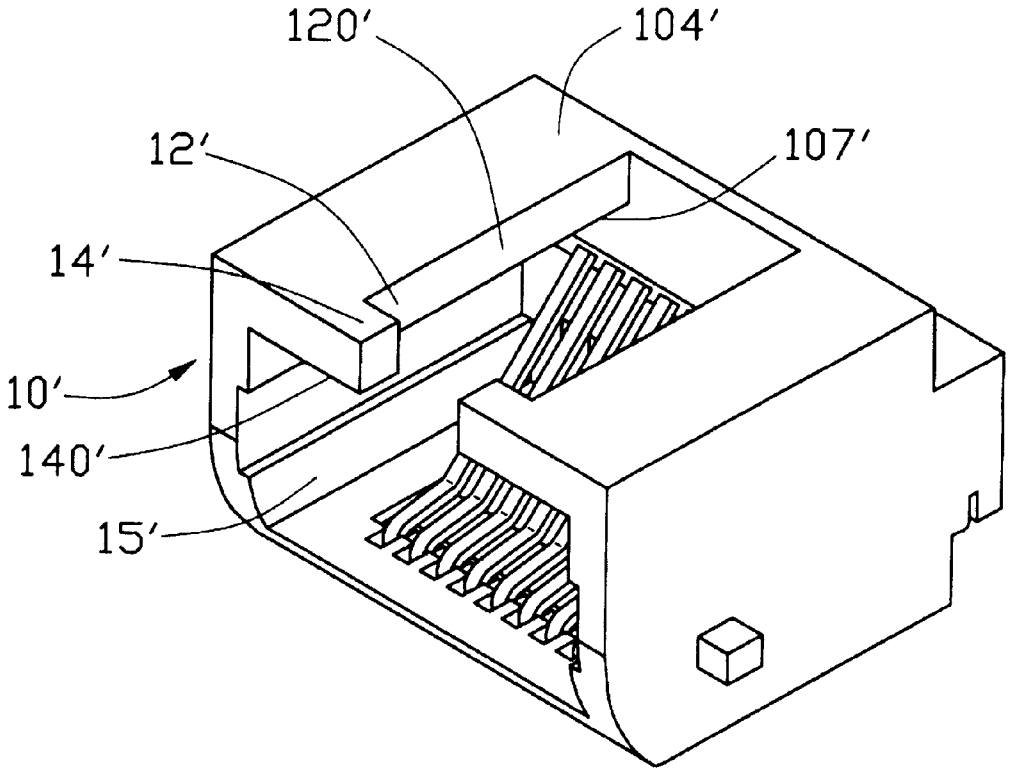
FIG. 5 is a low profile modular jack in accordance with a second embodiment of the present invention.
Figure 6:
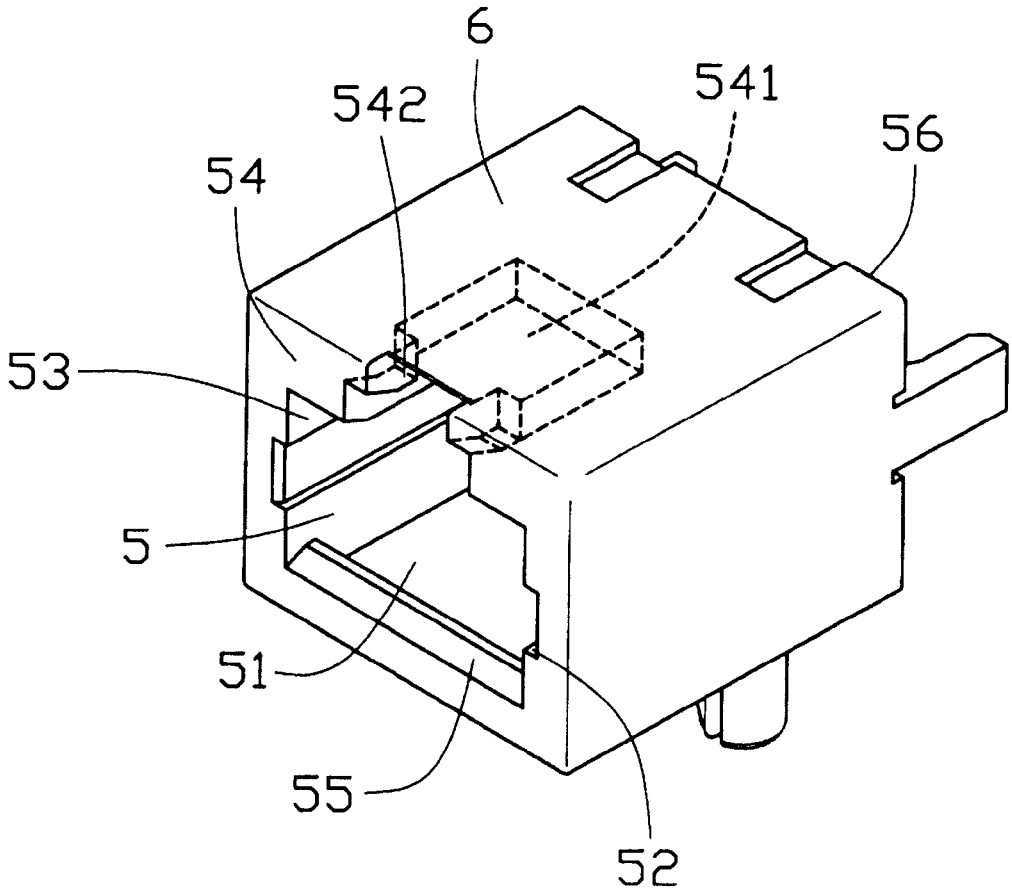
FIG. 6 (PRIOR ART)
FIG. 6 is a perspective view of a conventional modular jack.

Referring to FIG. 3, the thickness of the top wall 104 is reduced because the pair of upper blocks 542 of the conventional modular jack connector shown in FIG. 5 is replaced by the stoppers 32 which perform the same function, and the height 'H' of the modular jack in accordance with the present invention is reduced. Thus, the modular jack of the present invention meets the requirement of the miniaturization of the notebook. Additionally, the bottom portion of the housing 10 is rearward offset from the upper portion thereof wherein the two side walls around the corresponding corners are of a round configuration so as to not only comply with the contour of the outer casing but also allow titling installation of the plug for easing insertion or withdrawal of the plug relative to the jack.

FIG. 5 shows a second embodiment of the present invention. An insulative housing 10' has a pair of protrusions 14' extending toward each other into an opening 12' communicating with a receiving space 15' and beyond corresponding sidewalls 120' of the opening 12'. A latch of a plug connector (not shown) is retained in the opening 12' by the protrusions 14' and has the same function as the stoppers 32 shown in FIG. 2. Each protrusion 14' has a bottom face 140' flush with an inner bottom side 107' of a top wall 104'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack comprising:

an insulative housing having a pair of sidewalls, a top wall and a rear wall together defining a receiving space therebetween, the top wall defining an opening in a front face thereof, the opening defining a pair of opposite sidewalls;

a plurality of terminals received in the insulative housing; and a shield enclosing the insulative housing and comprising a pair of side plates and a top plate respectively corresponding to the pair of sidewalls and the top wall of the housing, the top plate defining a window in a front edge thereof in communication with the opening and having a pair of opposite stoppers extending into the window, the stoppers extending beyond corresponding sidewalls of the opening.

2. The modular jack as described in claim 1, wherein each stopper of the shield has a protrusion upwardly extending from a rear edge thereof.

3. The modular jack as described in claim 1, wherein each sidewall of the insulative housing has a block formed on an outer side thereof and each side plate of the shield defines a hole for receiving a corresponding block.

4. The modular jack as described in claim 1, wherein the rear wall of the insulative housing has a pair of posts extending downwardly from a bottom end thereof.

5. An electrical connector assembly comprising:

a receptacle connector comprising:

an insulative housing having a pair of sidewalls, a top wall and a rear wall together defining a receiving space therebetween, the top wall defining an opening in a front face thereof, the opening defining a pair of opposite sidewalls;

a plurality of terminals received in the insulative housing; and a shield enclosing the insulative housing and comprising a pair of side plates and a top plate respectively corresponding to the pair of sidewalls and the top wall of the housing, the top plate defining a window in a front edge thereof in communication with the opening and having a pair of opposite stoppers extending into the window, the stoppers extending beyond corresponding sidewalls of the opening; and a mating plug connector being inserted into the receiving space and having a latch formed thereon, the latch being retained in the window of the shield by the pair of stoppers.

6. The electrical connector assembly as described in claim 5, wherein each stopper has a protrusion upwardly extending from a rear edge thereof for abutting against the latch.

7. The electrical connector assembly as described in claim 5, wherein each sidewall of the insulative housing has a block formed on an outer side thereof and each side plate of the shield defines a hole for receiving a corresponding block.

8. The electrical connector assembly as described in claim 5, wherein the rear wall of the insulative housing has a pair of posts extending downwardly from a bottom end thereof.

9. An electrical connector assembly comprising:

an insulative housing defining a receiving space with a top wall thereabove, said top wall defining an opening therein;

a plurality of contacts disposed in the housing and extending into the receiving space;

a shielding enclosing the housing with a top plate covering said top wall, a window defined in said top plate with a pair of stoppers aside; and a plug inserted into the receiving space with an enlarged front portion received in said opening and a rear edge of said enlarged front portion further upwardly extending to be received in said window and abutting against the corresponding stoppers.

10. An electrical connector comprising:

an insulative housing defining a receiving space with a front opening in communication with an exterior, and a top wall thereabove, said top wall defining therein an opening for use with a latch of a complementary plug;

a plurality of contacts disposed in the housing and extending into the receiving space; and a lower portion of the housing around said front opening being rearwardly offset from an upper portion of the housing and two lower comers of two side walls of the housing around said front opening being configured to be in an arc shape.

* * * * *